United States Patent [19]

Stange

[11] 3,947,018

[45] Mar. 30, 1976

[54] UNIVERSAL FEEDER-STACKER

[75] Inventor: Klaus K. Stange, Pittsford, N.Y.

[73] Assignee: Xerox Corporation, Stamford, Conn.

[22] Filed: Dec. 19, 1974

[21] Appl. No.: 534,255

[52] U.S. Cl. ..... 271/99; 271/166; 271/197; 271/211

[51] Int. Cl.[2] ..... B65H 3/10; B65H 29/24

[58] Field of Search ..... 271/3.1, 11, 90, 94, 96, 271/97, 98, 99, 100, 108, 163, 165, 166, 194, 195, 197, 211, 212, 214; 214/8.5 D, 8.5 E, 6 DS, 6 FS

[56] References Cited

UNITED STATES PATENTS

| | | | |
|---|---|---|---|
| 1,942,527 | 1/1934 | Winkler et al. | 271/98 |
| 2,806,696 | 9/1957 | Bishop | 271/98 |
| 3,219,339 | 11/1965 | Gutierrez | 271/94 |
| 3,455,274 | 7/1969 | Modersohn | 271/96 |
| 3,503,606 | 3/1970 | Castellanet | 271/166 |

FOREIGN PATENTS OR APPLICATIONS

| | | | |
|---|---|---|---|
| 566,918 | 7/1931 | Germany | 271/98 |

*Primary Examiner*—Evon C. Blunk
*Assistant Examiner*—Robert Saifer

[57] ABSTRACT

Apparatus for removing the bottom sheets from a stack of sheets or inserting sheets at the bottom of a stack of sheets including an air plenum to provide an air cushion between the stack tray and the bottom sheet in the stack and vacuum feed means adapted for contact with the lead edge of a sheet to remove the sheet from the bottom of the stack or insert a sheet therein.

3 Claims, 2 Drawing Figures

UNIVERSAL FEEDER-STACKER

BACKGROUND OF THE DISCLOSURE

In many environments, particularly xerographic reproduction machines, it may be desirable to provide a sheet feeder wherein the sheets are removed from the bottom of a stack. Bottom feeders are particularly useful for feeding blank sheets of copy paper into a copy machine to enable continual replenishment of the stack without stopping operation of the machine as is necessary with top sheet feed devices. Further, if the sheet feeding device is to be utilized for feeding documents to the platen of a copy machine for imaging thereat, it may be desirable to feed from the bottom of the stack to maintain the proper pagination so that the output from the copy machine is pre-collated. In certain modes of operation, it may also be desirable to insert the copied document into the bottom of a stack of documents already copied so that the proper page orientation is maintained to enable subsequent copying in the proper order.

In a xerographic type reproduction machine, the developer material in the more common machines is permanently affixed to the copy sheet by the heat and pressure. Thus, sheets discharged from the xerographic machine may be quite warm and may cool into a non-planar condition. Therefore, in many instances, it may be desirable to provide a copy output tray wherein the sheets are inserted into the bottom of the stack to maintain the sheets in a planar condition as they are cooled.

Another problem that may be encountered in paper feeders is that in attempting to feed sheets seriatim, the feed mechanism is ordinarily energized and de-energized for each sheet being fed to provide the proper spacing therebetween. This results in fairly high inertial loads to start and stop the feed mechanism between each feed operation.

It is therefore the object of the present invention to provide a universal feeder-stacker adapted to remove sheets seriatim from the bottom of a stack of sheets or to insert sheets seriatim into the bottom of a stack of sheets and provide feed means associated therewith adapted for constant motion while providing intermittent feeding of sheets with minimal forces exerted on the sheets being handled thereby.

SUMMARY OF THE INVENTION

This invention relates to an apparatus for displacing the bottom sheet in a stack of sheets including a sheet tray adapted to receive a stack of sheets therein, the tray including perforated plenum means forming a planar base plate for supporting the stack of sheets in a planar conditon, means for supplying air under pressure to the plenum to create an air cushion between the bottom sheet in the stack and the base plate and vacuum feed means disposed adjacent the plenum for contact with the bottom sheet in the stack to move the sheet relative to the base plate.

DESCRIPTION OF THE PREFERRED EMBODIMENT

Figure 1:
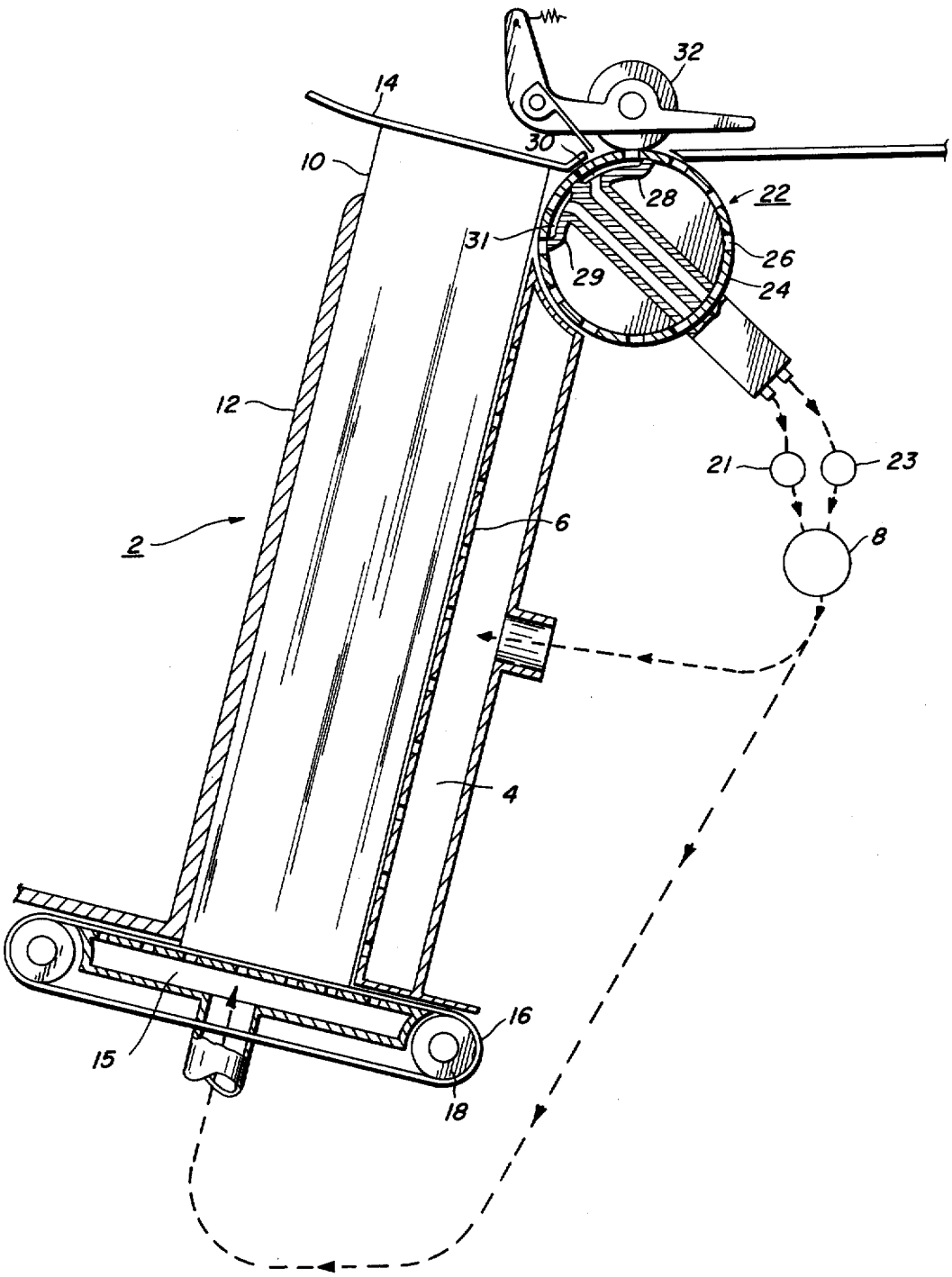
FIG. 1 is a schematic illustration of a first embodiment of the present invention employing a vacuum feed roll for displacing individual sheets in a stack of sheets relative to the stack tray; and, FIG. 2 is a second embodiment of the present invention employing a vacuum feed belt to displace sheets relative to the stack tray.
Figure 2:
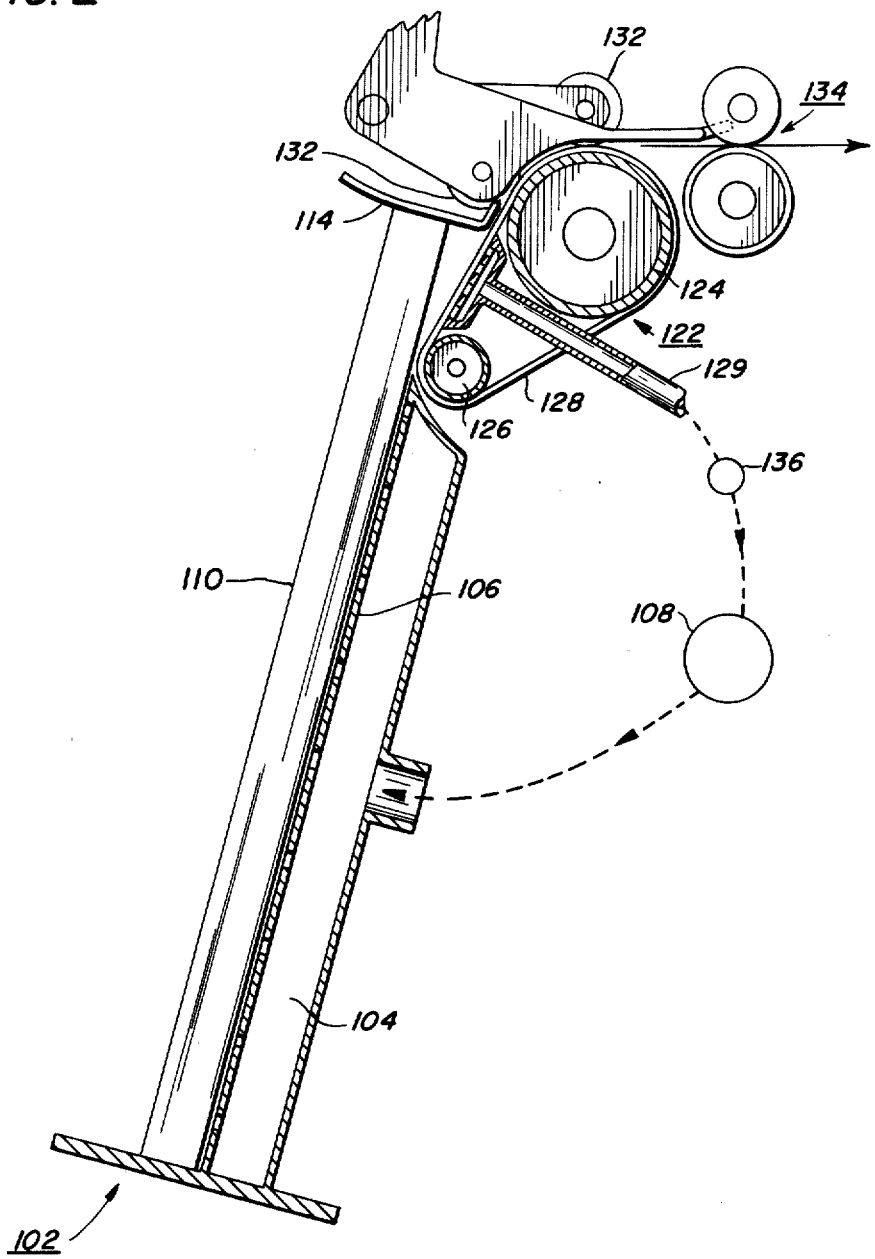

Referring to FIGS. 1 and 2 there is disclosed a universal feeder-stacker adapted for feeding or receiving documents to be copied or for feeding or receiving copy sheets in an automatic reproduction machine. For an example of a document handler wherein the disclosed device may be utilized, reference may be had to U.S. Pat. No. 3,829,082, commonly assigned with the present application. For an example of an automatic reproduction machine wherein the present invention may be utilized as a sheet feeding or copy stacker, reference may be had to U.S. Pat. No. 3,820,777, commonly assigned with the present application.

Referring particularly to FIG. 1, there is illustrated a sheet feeding-stacking apparatus, including a stack tray 2 comprised of a plenum member 4 having a perforated planar base plate 6, the plenum 4 being adapted for connection to a suitable source of air schematically illustrated at 8 to produce an air cushion between plate 6 and the bottom sheet of the stack of sheets 10 resting thereagainst. The tray further includes a follower plate 12 adapted to maintain the sheets in the stack and provide a slight downward force on the stack against plate 6. A top plate 14 and suitable side plates (not illustrated) are provided to completely enclose the stack to minimize the escape of air from beneath the stack and reduce the quantity of air required to produce an air cushion between the stack and plate 6. When the apparatus is to be used as a sheet feeder, an air plenum 15 may be utilized to provide an air cushion at the bottom edge of the sheets to minimize the frictional engagement of the sheet edges with the bottom edge guide and assure constant movement of sheets in the stack toward plate 6. To further aid in moving the sheets toward the right as illustrated in FIG. 1, a perforated movable belt 16, suitably mounted on rolls 18 and 20 may be provided to constantly urge the sheets toward plate 6.

A vacuum take-away or insertion roll assembly 22 is provided comprised of an outer rotatable member 24 having perforations 26 therein. Stationary internal members or shoes 28 and 29 having arcuate openings 30 and 31 respectively provide communication between the perforations 26 in roll 24 and the interior of shoes 28, 29. The shoes are adapted for connection to a source of vacuum shown schematically at 8. An idler roll 32, adapted for cooperation with rotatable member 24, is provided for engagement of a sheet between roll 32 and member 24 to positively grip the sheets presented therebetween and remove the sheets from the stack or insert the sheets into the stack depending upon the direction of rotation of rotatable member 24.

Considering the operation of the embodiment illustrated in FIG. 1 as a sheet feeder, upon initial actuation thereof, air under pressure is supplied by means 8 to plenum 4 and plenum 15 to float the bottom sheet in the stack a slight distance above perforated base plate 6. Roll assembly 22 is located such that the outer surface of the roll does not contact the bottom sheet in the stack when the stack is floated by the air cushion between plate 6 and the stack. As such, roll assembly 22 may be constantly rotated during the entire feeding operation. Upon a signal from the machine with which the feeder is utilized, valves 21 and 23 located between vacuum source 8 and shoes 28, 29 are opened, the vacuum thereby drawn through roll assembly 22 draws the bottom sheet against movable member 24 and retains the sheet thereon for removal of the sheet from the stack 10.

To utilize the apparatus illustrated in FIG. 1 as a sheet stacker, a sheet is fed into the nip between idler roll 32 and roll assembly 22. At that time, valve 23 is opened to provide vacuum through shoe 28 to retain the sheet on the upper portion of member 24 which brings the lead edge of the sheet into close proximity with the sheets already in the stack. After the lead edge of the sheet reaches a position completely overlying shoe 29, valve 21 is opened to provide maximum attraction between the sheet and roll assembly 22 for driving the sheet into the area between plate 6 and the bottom-most sheet in the stack. Once the sheet is bottomed in the stack, valves 21 and 23 are closed or in the alternative, valve 21 could be closed, allowing valve 23 to remain open to provide vacuum at shoe 28 to receive the next sheet presented thereto.

Referring to FIG. 2 there is illustrated a second embodiment of a sheet feeding-stacking apparatus, including a stack tray 102 comprised of a plenum member 104 having a perforated planar base plate 106, the plenum 104 being adapted for connection to a suitable source of air schematically illustrated at 108 to produce an air cushion between plate 106 and the bottom sheet of the stack of sheets 110 resting thereagainst. A top plate 114 and suitable side plates (not illustrated) are provided to completely enclose the stack to minimize the escape of air beneath the stack and reduce the quantity of air required to produce an air cushion between the stack and plate 106.

A vacuum take-away or insertion belt assembly 122 is provided comprised of a reversible drive roll 124 and an idler roll 126 having a perforate belt 128 mounted for movement therearound. A stationary internal shoe 129 having perforations therein is provided for connection to a source of vacuum shown schematically at 108. A pair of idler rolls 132 are provided for cooperation with belt 128 opposite roll 124 to positively grip the sheets between idler rolls 132 and belt 128 and remove the sheets from the stack or insert the sheets into the stack depending upon the direction of rotation of drive roll 124. A take-away roll pair 134 is provided adjacent the belt assembly to present sheets thereto or remove sheets therefrom.

Considering the operation of the embodiment illustrated in FIG. 2 as a sheet feeder, upon initial actuation thereof, air under pressure is supplied by means 108 to plenum 104 to float the bottom sheet in the stack a slight distance above perforated base plate 106. Roll 126 of belt assembly 122 is located such that the outer surface of belt 128 does not contact the bottom sheet in the stack when the stack is floated by the air cushion between plate 106 and the stack. As such, belt assembly 122 may be constantly energized during the entire feeding operation. Upon a signal from the machine with which the feeder is utilized, a valve 136 located between vacuum source 108 and shoe 129 is opened. The vacuum thereby drawn through shoe 129 and belt 128 draws the bottom sheet in the stack against moving belt 128 and retains the sheet thereon for removal of the sheet from the stack.

The belt 128 carries the sheet into the nip formed between the belt on roll 124 and idler rolls 132 to mechanically grip the lead edge of the sheet and carry the sheet to take-away roll pair 134 for subsequent transport of the sheet.

In certain circumstances, the use of a belt as illustrated in FIG. 2 has advantages over the vacuum roll assembly illustrated in FIG. 1. As can be seen by reference to FIG. 2, when vacuum is applied to shoe 129, the entire portion of the sheet above roll 126 is acted upon by the vacuum and drawn toward the belt. This required minimal vacuum because of the large planar area of the sheet opposite shoe 129 and the requirement for bending the sheet only in the area opposite roll 126 as contrasted to the embodiment of FIG. 1 wherein the sheet must be deformed along the entire upper portion thereof to conform to the arcuate surface of rotatable member 24. By bending the sheet opposite roll 126, the portion of the sheet thereabove acts somewhat as a lever arm to aid in overcoming the beam strength of the sheet.

To utilize the apparatus illustrated in FIG. 2 as a sheet stacker, a sheet is fed into the nip of roll pair 134 and carried thereby into the nip formed between the belt 128 and idler rolls 132 opposite roll 124. After the lead edge of the sheet reaches a position overlying shoe 129, valve 136 is opened to provide maximum attraction between the sheet and belt 128 for driving the sheet into the area between plate 106 and the bottom-most sheet in the stack. Once the sheet is bottomed in the stack, valve 136 is closed to allow the beam strength of the paper to move the trailing edge thereof away from the belt to clear the entrance for receipt of subsequent sheets therein.

While both the embodiments of FIGS. 1 and 2 have been described in the feed mode as having a constantly rotating feed belt or roller, in the event that the feeder mechanism is to be utilized as a separator-feeder-registration device, the roll member 24 or belt 128 may be stationary when the vacuum to the vacuum shoes 28, 29, or 129 is applied. After the sheet is secured to the frictional surface of the belt or roll member, the feed member may be actuated and gradually accelerated in time with machine timing to deliver the sheet thereon to the downstream rolls 134 or subsequent transports of the machine with which the feeders are utilized in synchronism with the machine processing stations so that the sheet is presented thereto at the proper time and in registration. Because of the secure grip obtained by means of the vacuum roll or belt and the minimal force needed to remove individual sheets from the stack, skew is not produced in the sheets as they are withdrawn from the stack and therefore deskewing at a subsequent processing station is unnecessary. If desired, a servo controlled drive system may be employed with the universal feeder-stacker to assure delivery of sheets separated therefrom at the precise timing necessary in the machine with which the feeders are utilized.

Further, it should be understood that when utilizing the disclosed devices as stackers, rather than shutting off the vacuum to the vacuum shoes when a sheet is bottomed in the stack, the disclosed vacuum valves could be combination vacuum/pressure valves and as the sheet is bottomed in the stack, the vacuum could be switched to pressure to positively drive the trailing edge of the sheets against the remainder of the sheets in the stack. The pressure may be maintained until the lead edge of the succeeding sheet passes a suitable sensor (not shown), at which time the pressure may be switched to vacuum. This may be particularly useful in those instances where the stacker is being utilized with very flexible paper and the beam strength thereof may be insufficient to move the trailing edge of the sheet out of the path of incoming subsequent sheets.

When utilizing the disclosed devices as feeders, the possibility of multiple sheets being fed thereby is nonexistent since the air provided by the floatation plenums not only provides a cushion between the bottom sheet in the stack and the plenum surface but also provides a cushion between the bottom sheet and subsequent sheets in the stack due to percolation of air through the bottom sheet and escape of air from beneath the bottom sheet around the edges thereof into the space between the bottom sheet and subsequent sheets in the stack. Since the sheets in the stack are completely enclosed except for the top edge thereof, as air escapes from the space between the first sheet and the remaining sheets thereabove, the air expands as it reaches the top portion of the sheet and causes the leading edge of the bottom sheet to be separated slightly from the remainder of the sheets in the stack, therefore instituting a slight separation of the bottom sheet in the stack from the remainder of the sheets so that vacuum supplied to the roll assembly 22 or belt 128 is not pulled through the bottom sheet and the next sheet thereabove which could produce a multi-feed.

Through the use of the disclosed vacuum roll or belt assembly and the use of air floatation to minimize the drag force on a sheet being inserted or removed from the bottom of the stack, a universal sheet feeder-stacker is provided which allows continual operation of the moving elements thereof to provide sequential feeding or stacking and which subject the sheets handled thereby to minimal loads in a very positive manner to minimize sheet misfeeds or multi-feeds in the feed mode and prevent sheet jams caused by collision of the leading edge of the sheet being stacked with the preceding sheets stacked in the tray. Further, by feeding from the bottom of a stack and/or inserting sheets into the bottom of a stack, the machine operator may constantly replenish the sheets in the stack when in the feed mode and may constantly remove completed sheets or documents from the stack when in the stack mode.

While I have described a preferred embodiment of my invention, it should be understood that the invention is not limited thereto but may be otherwise embodied within the scope of the following claims.

What is claimed is:

1. Apparatus for displacing the bottom sheet in a stack of sheets comprising:

a sheet tray adapted to receive a stack of sheets therein, said tray including perforate plenum means forming a planar base plate for supporting the stack of sheets in a planar condition;

means for supplying air under pressure to said plenum means to create an air cushion between the bottom sheet in the stack and said planar base plate;

vacuum feed means disposed adjacent said plenum means for contact with the bottom sheet in the stack to move the sheet relative to said planar base plate, said vacuum feed means comprising a rotatable roll having vacuum ports therein;

a stationary shoe disposed interiorly of said roll, said shoe having an arcuate opening therein adapted to provide communication between the interior of said shoe and the vacuum ports in said roll;

vacuum means adapted for connection to the interior of said shoe to draw a vacuum through the ports in said rotatable roll and retain the lead edge of a sheet thereon, rotation of said roll thereby moving the sheet retained thereon relative to said plenum means;

said rotatable roll being reversible, rotation of said roll in a direction such that the surface thereof adjacent said planar base plate moves away from said base plate causing the bottom sheet in the stack to be separated from the remainder of the sheets in the stack and fed therefrom, rotation of said roll in the opposite direction causing a sheet retained thereon to be inserted into the stack as the bottom sheet thereof; and, an idler roll adapted for cooperation with said vacuum roll, entry of a sheet between said idler roll and said vacuum roll causing the sheet to be transported thereby.

2. Apparatus for displacing the bottom sheet in a stack of sheets comprising:

a sheet tray adapted to receive a stack of sheets therein, said tray including perforate plenum means forming a planar base plate for supporting the stack of sheets in a planar condition;

means for supplying air under pressure to said plenum means to create an air cushion between the bottom sheet in the stack and said planar base plate;

vacuum feed means disposed adjacent said plenum means for contact with the bottom sheet in the stack to move the sheet relative to said planar base plate, said vacuum feed means comprising a first rotatable roll disposed adjacent said base plate;

a second rotatable roll spaced from said first roll;

perforate belt means mounted on said first and second rolls, said second roll being located relative to said first roll and said base plate to provide a planar belt run forming an acute angle with the sheets disposed on said base plate;

a vacuum shoe disposed beneath said planar belt run;

vacuum supply means connected to said shoe to draw a vacuum through said perforate belt means and retain the lead edge of a sheet on said belt means, movement of said belt means causing the sheet retained thereon to be moved relative to said base plate, said rotatable rolls being reversible, movement of said belt means therearound away from said base plate causing the bottom sheet in the stack to be separated from the remainder of the sheets in the stack and fed therefrom, movement of said belt means in the opposite direction causing a sheet retained thereon to be inserted into the stack as the bottom sheet thereof, and, idler roll means adapted for cooperation with said belt means adjacent said second roll, entry of a sheet between said idler means and said belt causing the sheet to be transported thereby.

3. Apparatus for displacing the bottom sheet in a stack of sheets comprising:

a sheet tray adapted to receive a stack of sheets therein, said tray including perforate plenum means forming a planar base plate for supporting the stack of sheets in a planar conditon;

means for supplying air under pressure to said plenum means to create an air cushion between the bottom sheet in the stack and said planar base plate;

vacuum feed means disposed adjacent said plenum means for contact with the bottom sheet in the stack to move the sheet relative to said planar base plate, said planar base plate being inclined at a slight angle from vertical, the apparatus further including second perforate plenum means forming an edge support plate disposed substantially perpendicular to said planar base plate; and, perforate belt means adapted for running engagement with said edge support plate, said means for supplying air being connected to said second perforate plenum means to create an air cushion between said belt means and the edges of the sheets in said tray, movement of said belt toward said base plate maintaining the lower edges of the sheets in the stack against said base plate.

* * * * *